United States Patent [19]

Yuge et al.

[11] Patent Number: 4,905,840

[45] Date of Patent: Mar. 6, 1990

[54] BANKNOTE ACCOUNT AND ARRANGEMENT APPARATUS

[75] Inventors: Akio Yuge, Yokohama; Kazuhito Sasaki, Tokyo; Minoru Hirose, Chigasaki; Masatsugu Mukuge, Yokohama, all of Japan

[73] Assignee: Kabushiki Kaisha Toshiba, Kawasaki, Japan

[21] Appl. No.: 145,122

[22] Filed: Jan. 19, 1988

[30] Foreign Application Priority Data

Jan. 19, 1987 [JP] Japan ..... 62-8246

[51] Int. Cl.[4] ..... B07C 5/34; G06M 7/06

[52] U.S. Cl. ..... 209/534; 209/551; 377/8

[58] Field of Search ..... 209/534, 551; 235/379; 377/8; 271/298

[56] References Cited

U.S. PATENT DOCUMENTS

| | | | |
|---|---|---|---|
| 4,369,360 | 1/1983 | Tsuji | 235/379 |
| 4,500,002 | 2/1985 | Koshio et al. | 209/541 X |
| 4,653,647 | 3/1987 | Hashimoto | 209/534 |
| 4,681,229 | 7/1987 | Uesaka et al. | 209/534 |
| 4,694,963 | 9/1987 | Takesako | 209/534 |

*Primary Examiner*—Margaret A. Focarino

*Assistant Examiner*—Edward M. Wacyra

*Attorney, Agent, or Firm*—Cushman, Darby & Cushman

[57] ABSTRACT

A banknote account and arrangement apparatus includes a supply portion for supplying a bundle of banknotes in the apparatus one after another, a discrimination circuit for discriminating denomination, face, fitness, authenticity, and the like of the supplied banknotes, temporary stackers in which the banknote is stacked in an account mode, closed cassettes coupled to the temporary stackers, open pockets in which the banknote is stacked in an arrangement mode, a RAM for collecting data of the banknote stacked in the temporary stackers, a CPU for verifying the collected data of the banknote stacked in the temporary stackers with known data of the bundle of the banknotes, pushers and shutters for, only when a verification result is correct, stacking the banknote stacked in the temporary stackers in the closed cassettes, and a display portion for displaying the collected data. Sensors detect if the temporary stackers are full. When the sensors detect that the temporary stackers are full in the account mode, a stacking destination of the paper money is changed to the open pockets while continuously collecting the data. After the temporary stackers are replaced with empty ones, the banknote stacked in the open pockets are stacked in the temporary stackers without collecting the data.

10 Claims, 16 Drawing Sheets

BANKNOTE ACCOUNT AND ARRANGEMENT APPARATUS

BACKGROUND OF THE INVENTION

The present invention relates to a banknote account and arrangement apparatus which can perform denomination-arrangement, face-arrangement, fitness-arrangement, account, and the like of banknotes or negotiable papers.

Banknote processing apparatuses are classified into two types. That is, one of the two types is a banknote arrangement apparatus for an arranging job, i.e., for simply counting and arranging banknotes in an open pocket in accordance with denominations, face, fitness, and the like of the banknote. The other one is a banknote account apparatus for a stacking job, i.e., for counting and stacking banknotes in a cassette in accordance with denominations, face, fitness, and the like, and at the same time, for collecting data of a count and an amount of the banknotes. These two types of apparatuses are selectively used as needed.

However, in small retail stores and the like, an arranging job and a stacking job of the banknotes must be performed in a single space. Therefore, installation of the above two apparatuses requires a very large space and hence is undesirable. In addition, since each apparatus is expensive, installation of the two apparatuses is very costly for a user.

Furthermore, in a conventional banknote account apparatus, when only one cassette becomes full, account processing must be stopped even if other cassettes are empty unless this full cassette is replaced with another empty cassette. Therefore, the operation is interrupted each time one cassette becomes full, resulting in poor processing efficiency.

SUMMARY OF THE INVENTION

It is, therefore, an object of the present invention to provide a banknote account and arrangement apparatus which can perform both an arrangement job and an account job.

It is another object of the present invention to provide a banknote account and arrangement apparatus which can perform both the arrangement and account jobs and which can efficiently perform the account job without interruption even if a cassette becomes full.

According to this invention, a banknote account and arrangement apparatus comprises first stacking means for stacking arrangement banknotes, second stacking means for stacking account banknotes, discrimination means for discriminating a kind of a banknote, arrangement means for sorting and stacking the banknote in said first stacking means in accordance with a discrimination result of said discrimination means, account means for sorting and stacking the banknote in said second stacking means in accordance with the discrimination result, and means for selecting one of either the account operation or the arrangement operation.

DETAILED DESCRIPTION OF THE PREFERRED EMBODIMENT

An embodiment of a banknote account and arrangement apparatus according to the present invention will be described below with reference to the accompanying drawings.

Figure 1:
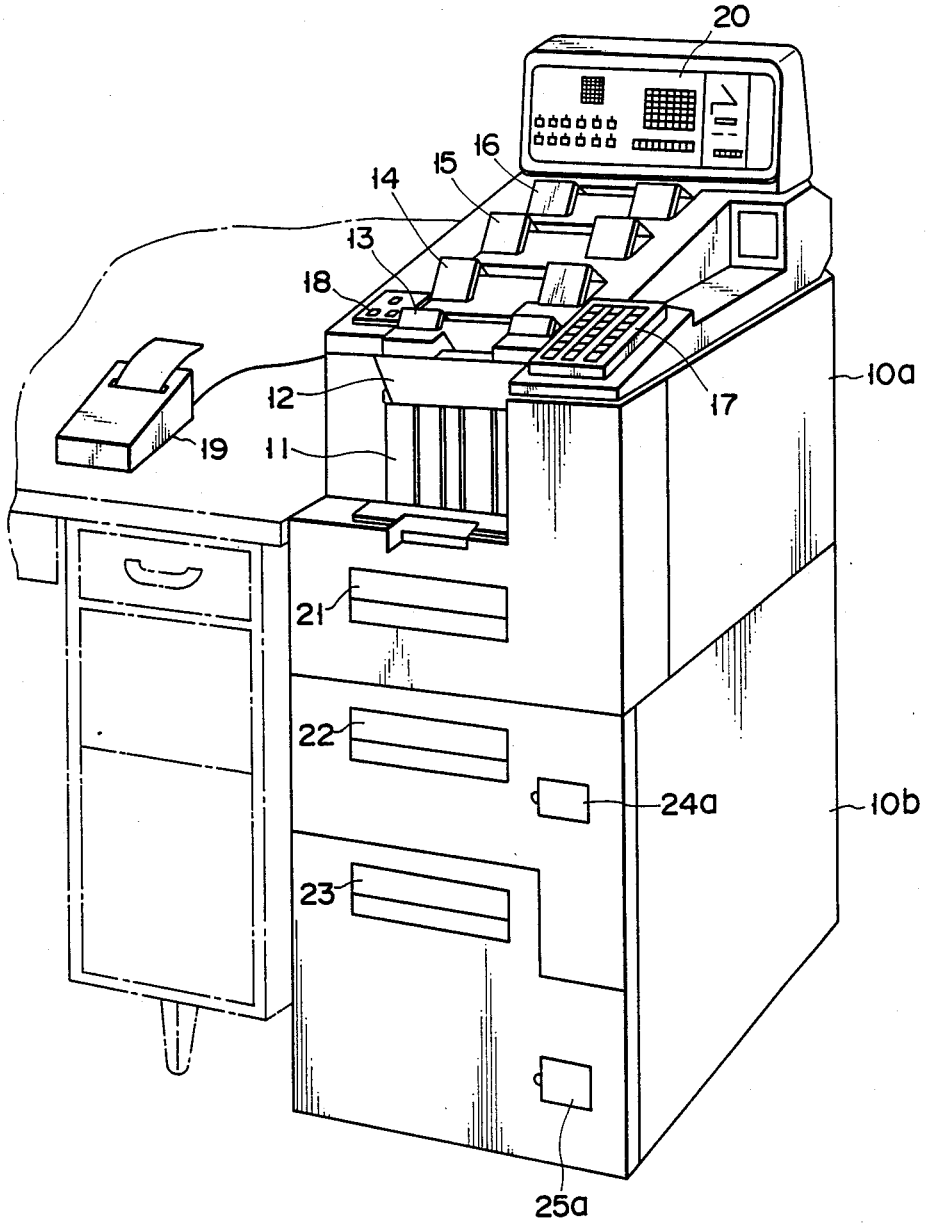
FIG. 1 is a perspective view showing an outer appearance of an embodiment of a banknote account and arrangement apparatus according to the present invention.

FIG. 1 is a perspective view schematically showing an embodiment of a banknote account and arrangement apparatus. This embodiment comprises banknote counting portion 10*a* for discriminating denominations, authenticity, fitness (fit/unfit for reuse), face (obverse/reverse), and the like of banknotes and counting the banknotes; and banknote stacking portion 10*b* for arranging and stacking the supplied banknotes in a closed cassette. The term "closed" of closed cassette means that the cassette is not open for an operator and the operator can not arbitrarily pick up a banknote therefrom. Normally, portions 10*a* and 10*b* are vertically coupled with each other and are separated as needed.

Supply portion 11 is provided at a front surface of counting portion 10*a* and feeds a large number of stacked banknotes into counting portion 10*a*. Vertically-movable push member 12 is provided on supply portion 11 and pushes the banknotes to be fed.

Open pockets 13, 14, 15, and 16 are provided on an upper surface of counting portion 10*a* in which banknotes discriminated by a discrimination portion (to be described later) are arranged and stacked in accordance with discrimination results. The term "open" of open pockets 13, 14, 15, and 16 means that the pockets are open for an operator and the operator can arbitrarily pick up a banknote therefrom. A central portion of each of pockets 13, 14, 15, and 16 is notched so that the arranged/stacked banknote can be easily picked up. Openable covers 13*a*, 14*a*, 15*a*, and 16*a* (FIG. 2) are provided at the central portions of pockets 13, 14, 15, and 16. Note that pocket 13 is provided to stack banknotes to be rejected.

Operation panel 17 is provided at the right side of the open pockets. Panel 17 has operation start, operation stop, and operator number input switches and the like. Auxiliary operation panel 18 is provided at the left side of the open pockets. Panel 18 has main switches of panel 17, i.e., the operation start switch, the operation stop switch, and the like. Therefore, two operators can operate the apparatus at the same time from the right and left sides of the apparatus by two operation panels 17 and 18. Note that a 10-step rotary switch (not shown) is provided on operation panel 18 and sets a discrimination level of fitness (e.g., contamination, damage, the presence/absence of an adhesive tape, and the like of a banknote).

Compact printer 19 is connected to counting portion 10*a* and prints out processing data.

Display unit 20 is provided at an uppermost portion of counting portion 10*a*. Unit 20 includes a display portion for displaying a count and an amount of banknotes, abnormality, and the like and a switch portion for setting modes of counting, face, fitness, stacking, account, and the like. Unit 20 can be turned toward an operator.

Pull handle 21 is provided on the front surface of counting portion 10*a* to pull out a mechanical portion when paper is jammed or for cleaning. Pull handle 22 of a temporary stacker and pull handle 23 of a closed cassette are provided on the front surface of stacking portion 10*b*. Reference numerals 24*a* and 25*a* denote covers for concealing key holes provided for unlocking electromagnetic locks 24 and 25 to be described later.

Figure 2:
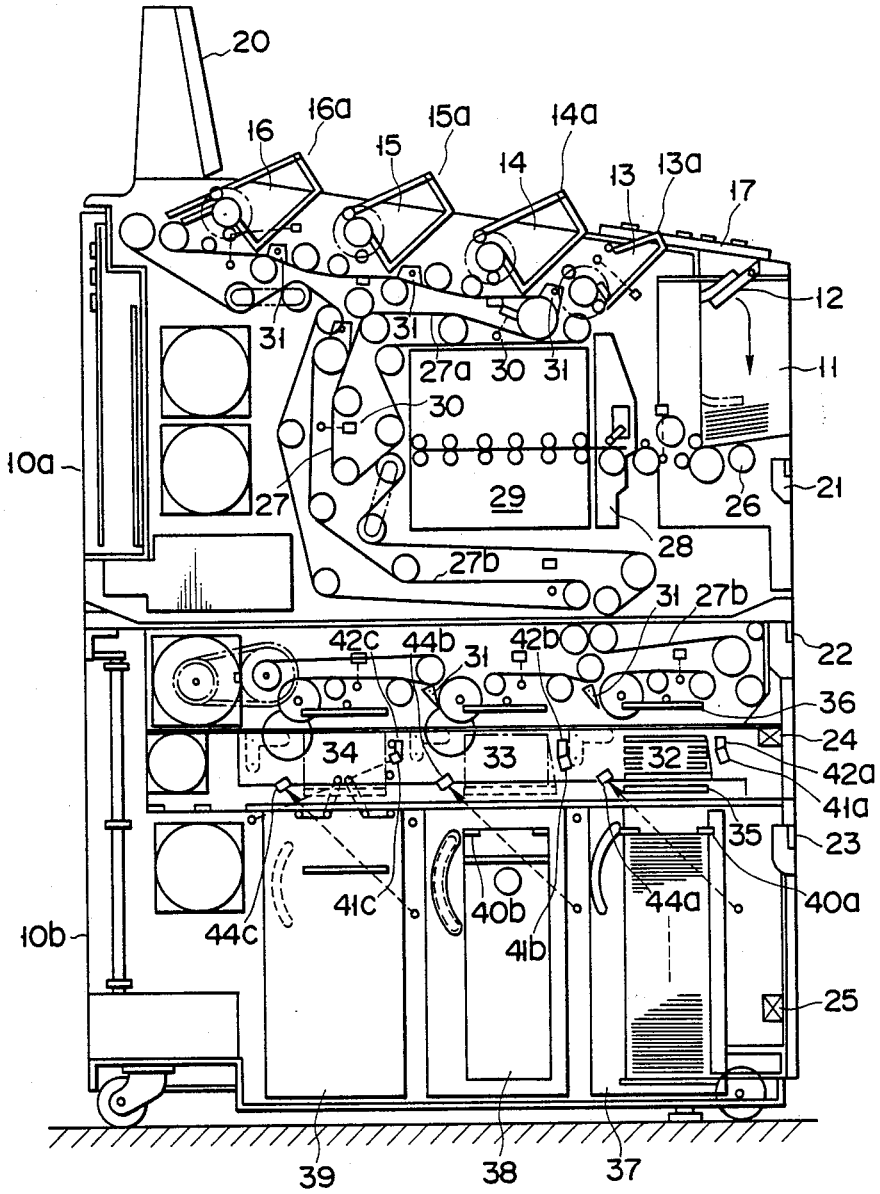
FIG. 2 is a sectional view of FIG. 1.

FIG. 2 shows the internal structure of the banknote processing apparatus shown in FIG. 1. Pickup roller 26 is provided below supply portion 11 to abut against a stack of banknotes and to pick them up one by one by a frictional force. A banknote picked up by roller 26 is conveyed on conveyor path 27 made up of a belt and rollers. Thickness detector 28, for detecting whether two or more banknotes are stacked and picked up at the same time, and discrimination portion 29, for discriminating denominations, authenticity, fitness, face, and the like of fed banknotes and counting the banknotes, are provided on path 27. An optical or magnetic detector is used as discrimination portion 29.

Sensors 30, each made up of a light-emitting element and a light-receiving element, are provided at a plurality of positions on path 27 and detect passing banknotes. Gate 31 is provided at a branch of the conveyor path and distributes the banknotes. Downstream of discrimination portion 29, conveyor path 27 is branched into conveyor path 27*a*, for conveying the banknotes to open pockets 13, 14, 15, and 16, and conveyor path 27*b*, for conveying the banknotes to closed storage safes.

A plurality of gates 31 are also provided on path 27b. The banknotes are temporarily stacked in temporary stackers 32, 33, and 34, respectively. Shutter 35 is provided at a lower portion of each of stackers 32, 33, and 34, and vertically-movable pusher 36 is provided at its upper portion. When shutters 35 are opened and pushers 36 are moved downward, the banknotes temporarily stacked in stackers 32, 33, and 34 are forcibly pushed into closed cassette 37, 38, and 39, respectively. Check pawls 40*a*, 40*b*, and 40*c* pivotally supported by cassettes 37, 38, and 39 are provided so that the banknotes pushed into the cassettes are not returned to the temporary stackers when pushers 36 are moved upward. When pushers 36 are moved upward, shutters 35 are closed and returned to an initial state.

Electromagnetic lock 24, for pulling out the temporary stacking portion, is provided on the front surface of the temporary stackers, and electromagnetic lock 25, for pulling out the cassette portion, is provided on the front surface of the cassette portion. Locks 24 and 25 are operated as needed to limit pulling enable time of the stacking and cassette portions, respectively.

Detectors 41*a*, 41b, and 41c are provided near stackers 32, 33, and 34 and detect whether banknotes are present in the temporary stackers. Microswitches 42*a*, 42*b*, and 42*c* are provided above detectors 41*a*, 41*b*, and 41*c*, respectively, and detect whether pushers 36 are downwardly or upwardly moved. Empty detectors 43*a*, 43*b*, and 43*c* made up of light-emitting elements provided at cassettes 37, 38, and 39 and light-receiving elements provided at stackers 32, 33, and 34 detect whether cassettes 37, 38, and 39 are empty, respectively.

Figure 3:
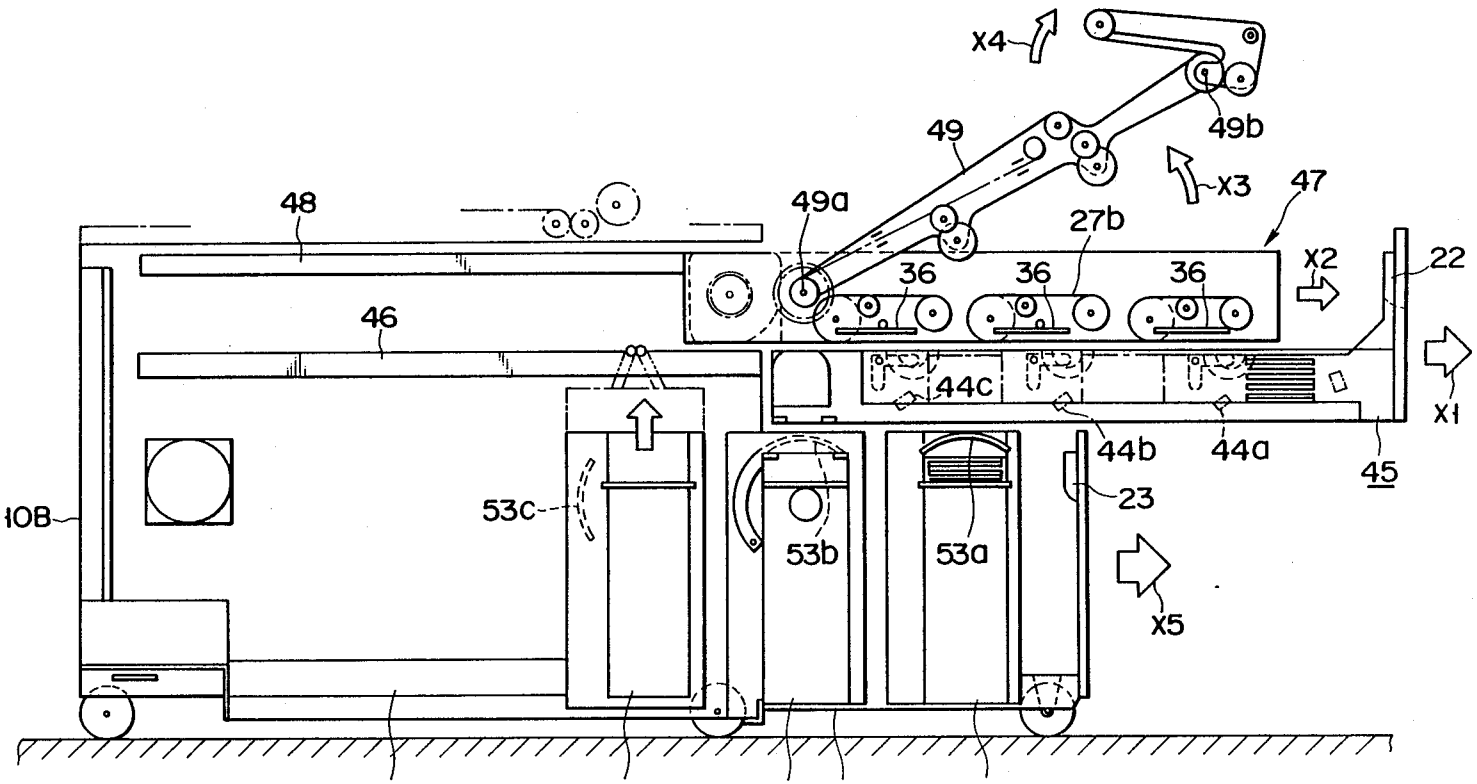
FIG. 3 is a sectional view showing a state wherein a temporary stacking portion and a stacking portion of the embodiment are pulled.

FIG. 3 is a side view showing movable members for holding the respective stackers and cassettes in the temporary stacking portion and the cassette portion. By unlocking electromagnetic lock 24, temporary stacking portion 45 can be pulled out along slide rail 46 in a direction of arrow x1. In this case, the banknotes temporarily stacked in stackers 32, 33, and 34 can be picked up by hand.

After stacking portion 45 is pulled in the direction of arrow x1, conveyor portion 47, located above stacking portion 45, for supplying banknotes, is pulled along slide rail 48 in a direction of arrow x2. Conveyor upper portion 49, which forms an upper portion of conveyor path 27, is pivoted about first pivot center 49*a* counterclockwise as indicated by arrow x3. Finally, upper portion 49 is pivoted about second pivot center 49*b* clockwise as indicated by arrow x4. Thus, a banknote jammed in conveyor portion 47 can be removed, and optical sensor 50 and the like can be easily cleaned.

By unlocking lock 25, cassette portion 51, having cassettes 37, 38, and 39, can be pulled out along slide rail 52 in a direction of arrow x5. When portion 51 is pulled out, covers 53*a*, 53*b*, and 53*c* provided to cassettes 37, 38, and 39 are pivoted clockwise to automatically close inlets of cassettes 37, 38, and 39. Therefore, the cassettes are closed.

After portion 51 is pulled out, cassettes 37, 38, and 39 can be pulled upward.

Figure 4A:
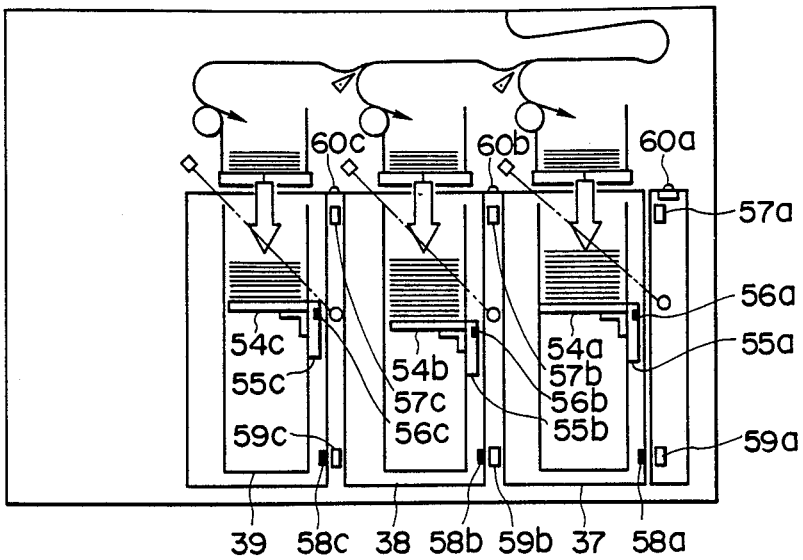
FIGS. 4A and 4B are sectional views showing how a collecting cassette is set.
Figure 4B:
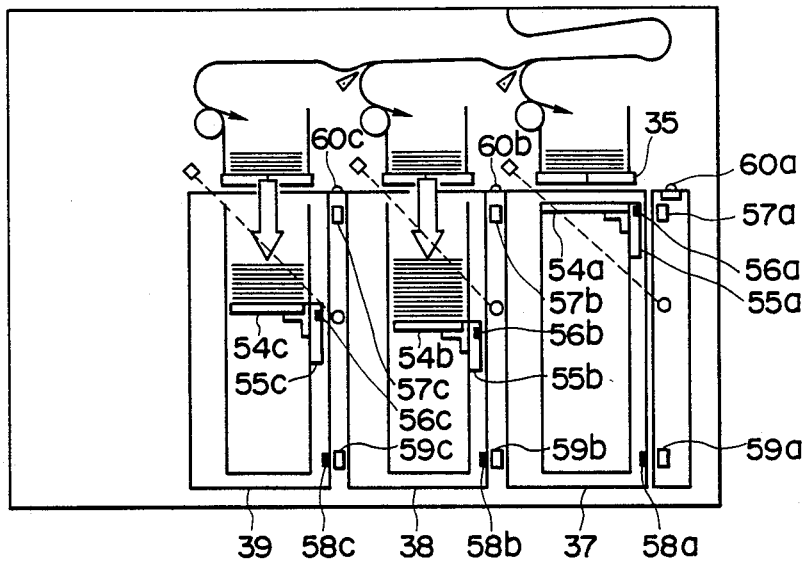

Cassette portion 51 is shown in detail in FIGS. 4A and 4B. Cassettes 37, 38, and 39 have backup members 54*a*, 54*b*, and 54*c*, respectively, each of which is supported by a slide shaft (not shown) and may be vertically moved. Magnets 56*a*, 56*b*, and 56*c* are provided to drive pieces 55*a*, 55*b*, and 55*c* of the backup members of cassettes 37, 38, and 39, respectively. Reed switches 57*a*, 57*b*, and 57*c* are provided at cassettes 37, 38, and 39. When cassettes 37, 38, and 39 are almost empty, switches 57*a*, 57*b*, and 57*c* are turned on.

Magnets 58*a*, 58*b*, and 58*c* are provided below cassettes 37, 38, and 39, and reed switches 59*a*, 59*b*, and 59*c* are provided at the cassettes 37, 38, and 39. When cassettes 37, 38, and 39 are correctly set, switches 59*a*, 59*b*, and 59*c* are turned on. Therefore, when switches 57*a*, 57*b*, 57*c*, 59*a*, 59*b*, and 59*c* are turned on, it can be determined that cassettes 37, 38, and 39 are correctly set.

LEDs 60*a*, 60*b*, and 60*c* are provided on the upper surface of cassette portion 51 so as to correspond to cassettes 37, 38, and 39 and may be turned on when cassettes 37, 38, and 39 are correctly set, respectively. Therefore, as shown in FIG. 4A, when banknotes are stacked in cassette 37, switch 57*a* and LED 60*a* are not turned on. When cassette 37 is empty and correctly set, as shown in FIG. 4B, LED 60*a* is turned on.

Figure 5:
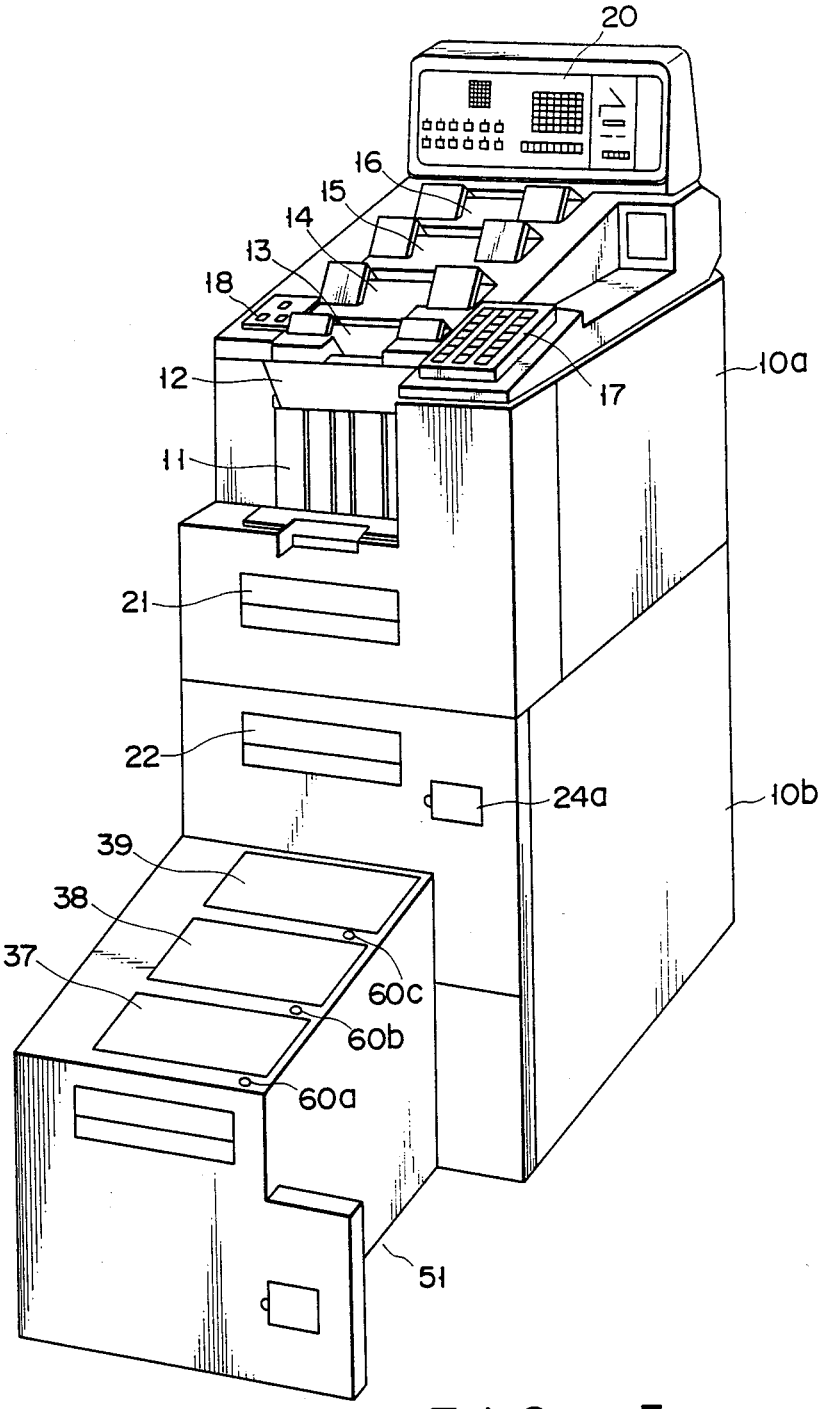
FIG. 5 is a perspective view showing a state wherein the collecting cassette portion of the embodiment is pulled.

When an operator replaces the cassettes, he or she pulls out cassette portion 51 as shown in FIG. 5 and replaces cassettes 37, 38, and 39. At this time, if LEDs 60*a*, 60*b*, and 60*c* are not turned on, the operator knows that the cassettes are not correctly set.

Figure 6:
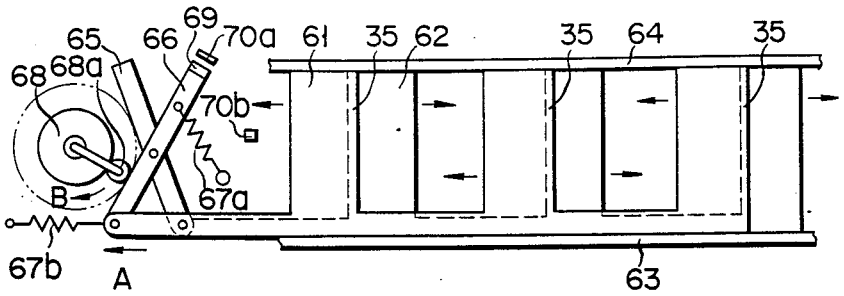
FIG. 6 is a plan view of a shutter attached to the collecting cassette portion.

Shutters 35 will now be described. As shown in FIG. 6, shutters 35 are made up of plates 61 and 62 with plate 61 being supported by slide rails 63 and 64. Plate 62 is also supported by slide rails (not shown). End portions of plates 61 and 62 are pivotally supported by end portions of opening/closing members 65 and 66, respectively. Members 65 and 66 pivotally support each other at the center and pivot in opposite directions in association with each other. End portions of member 66 and plate 61 are biased by springs 67*a* and 67*b* in a direction of arrow A, respectively.

In FIG. 6, the shutters are closed. When plate 61 moves in the direction of arrow A, plate 62 moves in the opposite direction.

Opening/closing members 65 and 66 are biased by roller 68*a* rotated by motor 68 to perform an opening/-closing operation. When roller 68*a*, rotated in a direction of arrow B, moves from a position shown in FIG. 6, plates 61 and 62 are moved by biasing forces of springs 67*a* and 67*b*, to open shutters 35 as indicated by an alternate long and short dashed line in FIG. 6.

Magnet 69 is provided at an end portion of opening/-closing member 66. Reed switches 70a and 70*b* are provided at shutter closing and shutter opening positions of the end portion of member 66, respectively. Switch 70*a* detects that shutters 35 are closed, and switch 70*b* detects that shutters 35 are open.

Figure 7A:
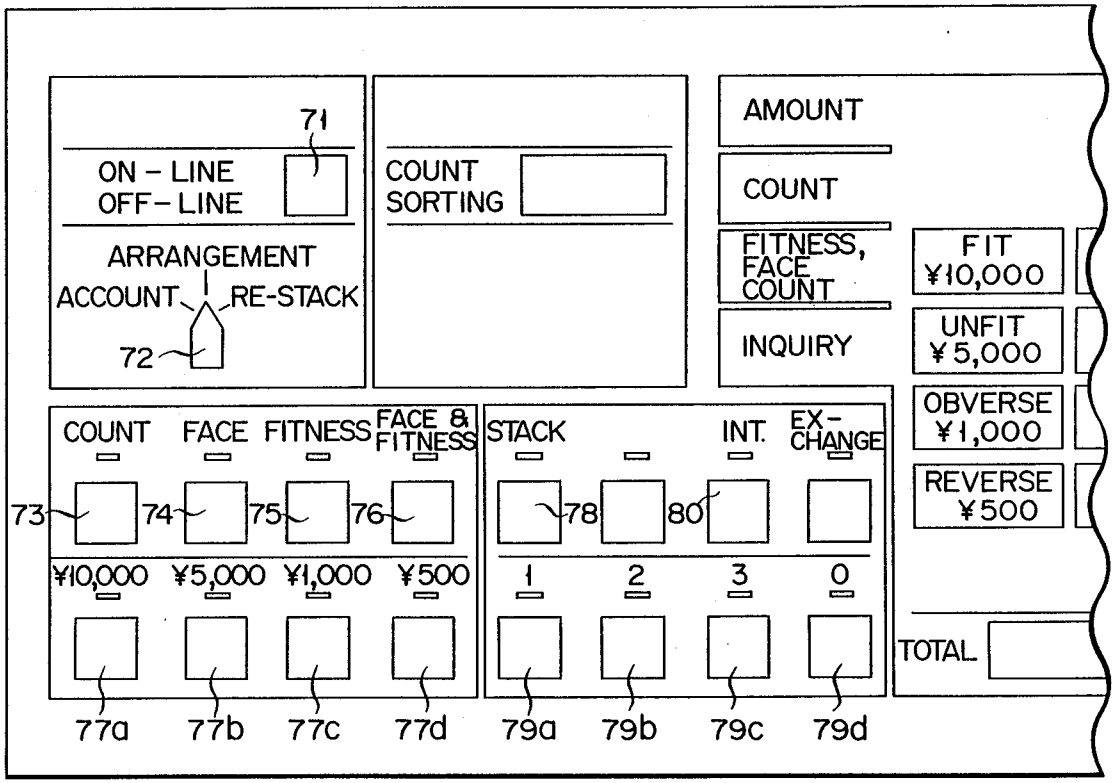
FIGS. 7A and 7B show a front view of a display portion of the embodiment.
Figure 7B:
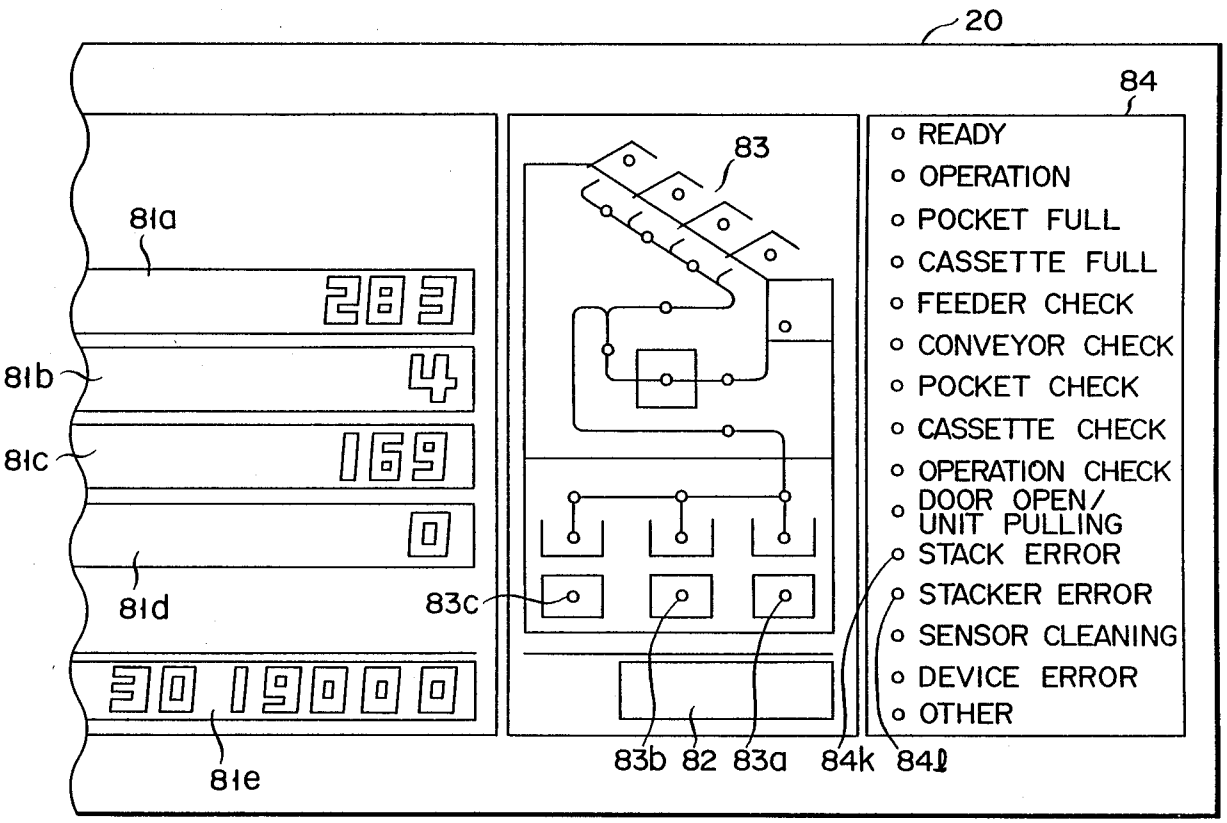

Display unit 20 is shown in FIGS. 7A and 7B. Unit 20 is made up of a switch portion and a display portion.

On-line/off-line selection key 71 for selecting on-line processing or off-line processing is provided at the upper left portion of unit 20. Key 71 is an alternate key and hence is switched upon each depression. Processing selected by key 71 can be confirmed by the ON/OFF state of LEDs (not shown) provided to the left of a lettering. Job selection key 72 for selecting an account (account/stacking) job, an arrangement job, and a re-stacking job is provided below key 71.

The account (account/stacking) job mentioned here is an operation in stores for inputting daily sale data or the like and collecting the data. The arrangement job is an operation for accounting banknotes in accordance with denominations, and arranging them in accordance with face and fitness. The re-stacking job is an operation for stacking banknotes, subjected to account processing (data collecting) but not stacked in cassettes 37, 38, and 39 (in this case, they are stacked in open pockets 14, 15, and 16), in cassettes 37, 38, and 39 without changing data collected in the account processing.

When the re-stacking job is selected, the stack mode set at the account job is automatically set. Therefore, the banknotes of the same denominations are stacked into the same cassettes for the account job.

Tables 1 and 2 show classifications of banknotes stored/stacked in the respective open pockets and cassettes (temporary stackers) during the account and arrangement jobs.

TABLE 1

| | Account Counting | | | |
|---|---|---|---|---|
| | Mixed | Sorted | | |
| Designated Denominations | None | One Denomination | Two Denominations | Three Denominations |
| Open Pocket 13 | All Denominations (Automatic Switching after full) ↓ | Designated Denomination (Automatic Switching after full) ↓ | 1st Denomination | 1st Denomination |
| Open Pocket 14 | All Denominations Automatic Switching after full) ↓ | Designated Denomination | 2nd Denomination | 2nd Denomtion |
| Open Pocket 15 Cassette 37 Cassette 38 Cassette 39 | All Denominations | NonDesignated Denominations | NonDesignated Denominations | 3rd Denominations |
| Reject Pocket 16 | Rejected | Rejected | Rejected | Rejected, NonDesignated Denomination |
| Capacity of Pocket Initial Value | Variable Max (About 200) | Variable | Variable | Variable |

| | Account Obverse/Reverse | |
|---|---|---|
| | Mixed | Sorted |
| Designated Denominations | None | One Denomination |
| Open Pocket 13 | All Denominations (Obverse) | Designated Denomination (Obverse) |
| Open Pocket 14 | All Denominations (Reverse) | Designated Denomination (Reverse) |
| Open Pocket 15 | All Denominations (Obverse and Reverse) | NonDesignated Denomination |
| Cassette 37 | | |
| Cassette 38 | | |
| Cassette 39 | | |
| Reject Pocket 16 | Rejected | Rejected |

TABLE 1-continued

| | | | | |
|---|---|---|---|---|
| Capacity of Pocket Initial Value | Variable | | Variable Max (About 200) | |
| | Account Stack | | | |
| | Mixed | | Sorted | |
| Designated Denomination | None | Mode-1 | Mode-2 | Mode-3 |
| Open Pocket 13 | | | | |
| Open Pocket 14 | | | | |
| Open Pocket 15 | | | | |
| Cassette 37 | All Denominations ↓ | 10,000 | 10,000 | 1,000 |
| Cassette 38 | All Denominations ↓ | 1,000 | 10,000 | 1,000 |
| Cassette 39 | All Denominations ↓ | 5,000 | Y 5,000 | Y 10,000 |
| | | | Y 1,000 | Y 5,000 |
| | | 500 | 500 | 500 |
| Reject Pocket 16 | Rejected | Rejected | Rejected | Rejected |
| Capacity of Pocket Initial Value | Fixed | Fixed | Fixed | Fixed |

TABLE 2

| | | | |
|---|---|---|---|
| | Arrangement Counting Sorted | | |
| Designated Denominations | One Denomination | Two Denominations | Three Denominations |
| Open Pocket 13 | Designated Denomination (Automatic Switching after full) ↓ | 1st Denomination | 1st Denomination |
| Open Pocket 14 | Designated Denomination | 2nd Denomination | 2nd Denomination |
| Open Pocket 15 | NonDesignated Denomination | NonDesignated Denomination | 3rd Denomination |
| Cassette 37 | | | |
| Cassette 38 | | | |
| Cassette 39 | | | |
| Reject Pocket 16 | Rejected | Rejected | Rejected, NonDesignated Denomination |
| Capacity od pocket Initial Value | Variable 100 | Variable | Variable |

| | | | | |
|---|---|---|---|---|
| | Arrangement | | | |
| | Obverse/Reverse | | Fitness | Obverse/ Reverse & Fitness |
| | Mixed | Sorted | Sorted | Sorted |
| Designated Denomination | No Designation | One Denomination | One Denomination | One Denomination |
| Open Pocket 13 | All Denominations (Obverse) | Designated Denomination (Obverse) | Designated Denomination (Fit) | Designated Denomination (Obverse and Fit) |
| Open Pocket 14 | All Denominations (Reverse) | Designated Denomination (Reverse) | Designated Denomination (Unfit) | Designated Denomination (Reverse and Unfit) |
| Open Pocket 15 | All Denominations (Obverse ans Reverse) | NonDesignated Denomination | NonDesignated Denomination | Designated Denomination (Unfit) |
| Cassette 37 | | | | |
| Cassette 38 | | | | |
| Cassette 39 | | | | |
| Reject Pocket 16 | Rejected | Rejected | Rejected | Rejected, NonDesignated Denomination |
| Capacity of pocket Initial Value | Variable | Variable | Variable | Variable |

Count key 73, face key 74, fitness key 75, and face & fitness key 76 are provided below job selection key 72 to set detailed arrangement items in the arrangement job. Y 10,000 key 77*a*, Y 5,000 key 77*b*, Y 1,000 key 77*c*, and Y 500 key 77*d* are provided below keys 73, 74, 75, and 76 to set denominations.

Subdivided modes of the arrangement job will be described below.

(1) Count mode

Supplied banknotes are arranged and counted in accordance with denominations, and 10,000-yen banknotes, 5,000-yen banknotes, and 1,000-yen banknotes are stacked in open pockets 14, 15, and 16, respectively.

(2) Face Mode

Banknotes of the denominations designated by keys *77a* to *77d* are arranged and counted in accordance with face. Obverse banknotes, reverse banknotes, and other banknotes are stacked in open pockets 14, 15, and 16, respectively.

(3) Fitness Mode

Banknotes of the denominations designated by keys *77a* to *77d* are arranged and counted in accordance with fitness. Fit (for reuse) banknotes, unfit (for reuse) banknotes, and other banknotes are stacked in open pockets 14, 15, and 16, respectively.

(4) Face & Fitness Mode

Banknotes of the denominations designated by keys *77a* to *77d* are arranged and counted in accordance with face and fitness. Obverse and fit banknotes, reverse and fit banknotes, and unfit banknotes are stacked in open pockets 14, 15, and 16, respectively.

Stack key 78 is provided at the right side of face & fitness key 76. When key 78 is depressed during the account job, a mode for stacking accounted banknotes in cassettes 37, 38, and 39 is set. Stacking mode selection keys *79a*, *79b*, *79c*, and *79d* are provided below key 78 to subdivide the stacking mode. When keys *79a*, *79b*, *79c*, and *79d* are depressed after key 78 is depressed, the following modes 1, 2, 3, and 0 are set, respectively.

(1) Mode 1

10,000-yen banknotes, 1,000-yen banknotes, and other banknotes are stacked in cassettes 37, 38, and 39, respectively.

(2) Mode 2

10,000-yen banknotes, 10,000-yen banknotes, and other banknotes are stacked in cassettes 37, 38, and 39, respectively.

(3) Mode 3

1,000-yen banknotes, 1,000-yen banknotes, and other banknotes are stacked in cassettes 37, 38, and 39, respectively.

(4) Mode 0

Banknotes of any denominations are sequentially stacked in cassettes 37, 38, and 39. That is, when cassette 37 becomes full, banknotes are stacked in cassette 38, and when cassette 38 becomes full, banknotes are stacked in cassette 39.

Note that setting (changing) of the stacking mode can be performed only when the cassette is replaced. That is, only when the cassettes are correctly set and an empty state of the cassettes is detected can mode setting (changing) be performed. In addition, once the stacking mode is set, the mode data is written in a RAM to be described later. Therefore, count processing can be performed during stacking mode by interruption. The stacking mode is automatically set again when interruption is released.

Interruption key 80 is provided above stacking mode selection key *79c*. When arrangement or account/count processing is to be performed using an open pocket not used in the account/stacking mode, key 80 is depressed after currently processed banknotes are stacked. In this case, processing can be performed in another mode while the data being processed remains stored. When the processing is completed, the stacking mode can be set again by depressing interruption key 80 or stack key 78.

When remaining banknotes are processed in the stacking mode again, a count of processed banknotes is added to the preceding count value. In addition, when stacking in the account mode is completed, counting and the like can be performed not by interruption. In this case, the stacking mode is set again by depressing stacking key 80 after the count processing is completed.

When count key 73 is depressed in the account mode, the count processing is performed using the open pockets. That is, in the account/stacking mode, banknotes are stacked in cassettes 37, 38, and 39. However, in the account/count mode, banknotes are stacked in open pockets 14, 15, and 16, and count data and the like are processed as in the account/stacking mode. This operation is performed when tellers directly account banknotes and the banknotes need not be stacked in the cassettes.

Numeric display portions 81*a*, 81b, 81*c*, 81*d*, and 81*e* are provided at the central portion of display unit 20. These numeric display portions display a count or an amount of counted banknotes in accordance with a result of discrimination portion 29. That is, display portion 81*a* displays a count or an amount of fit or 10,000-yen banknotes, display portion 81*b* displays that of unfit or 5,000-yen banknotes, display portion 81*c* displays that of obverse or 1,000-yen banknotes, display portion 81*d* displays reverse or 500-yen banknotes, and display portion 81*e* displays a total amount. Display portions 81*a* to 81*d* always update and display count values during processing of banknotes.

Display portion 82 for displaying a state code of the apparatus is provided to the right of display portion 81*e*. Display portion 83, for schematically displaying a state of each unit of the apparatus, is provided above display portion 82. LEDs 83*a*, 83*b*, and 83*c* are turned on if cassettes 37, 38, and 39 are not empty when they are set. Display portion 84 for displaying a normal state and an abnormal state of the apparatus in units of items is provided to the right of display portion 83. Display portion 84 includes headings of ready, operation, pocket full, cassette full, feeder check, conveyor check, pocket check, cassette check, operation check, door opening/unit pulling, stack error, stacker error, sensor cleaning, device error, and other items and LEDs for illuminating the headings. In this case, "stack error" occurs when banknotes stacked in the temporary stacker are stacked into the cassette. The LED of "stack error" is turned on when shutters 35 are opened and a predetermined time has elapsed, when pushers 36 moved downward are not returned and a predetermined time has elapsed, and when shutters 35 are not closed and a predetermined time has elapsed. The LED of "stacker error" is turned on when shutters 35 are opened or pushers 36 are operated while a command of the above storage operation is not sent.

Figure 8:
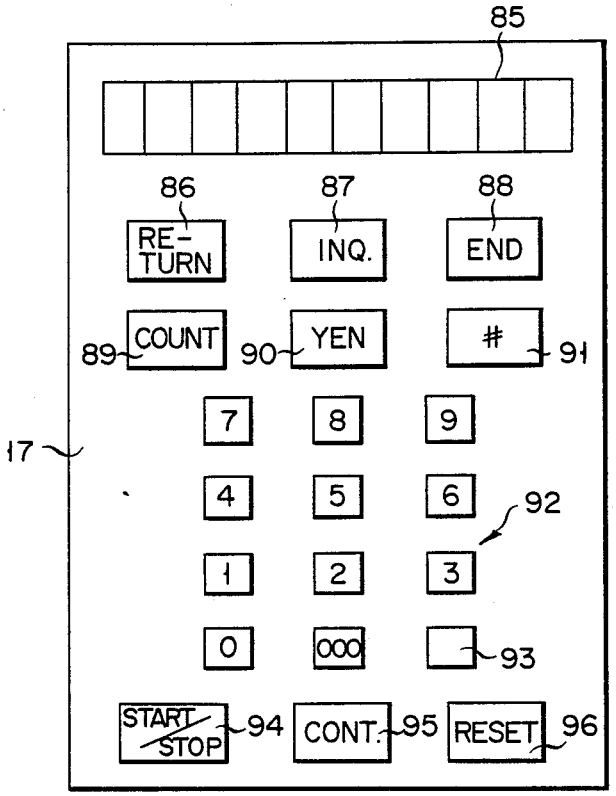
FIG. 8 is a front view of an operation portion of the embodiment.

Operation panel 17 will now be described. As shown in FIG. 8, panel 17 includes 7-segment/10-digit display portion 85, return key 86, inquiry key 87, end key 88, count key 89, yen key 90, # key 91, ten key pad 92, and display selection key 93. Start/stop key 94, continuation key 95, and reset key 96 are provided below ten key pad 92. Start/stop key 94 is depressed to start/stop an operation of banknote processing apparatus 10. Inquiry key 87 is depressed to perform a variety of collecting operations. A stacking operation with respect to open pockets 14, 15, and 16 is temporarily stopped each time a count of stacked banknotes reaches a predetermined count, and count key 89 is depressed to set the predetermined count. When key 89 is depressed once, 100 is set, and when key 89 is depressed twice, 200 is set. A count in units of other than 100 can be set by entering numeric value information by ten key pad 92 and then depressing count key 89. Display selection key 93 selects count display or amount display of each of display portions 81*a* to 81*d*. # key 91 is depressed before an operator number is input by ten key pad 92.

Figure 9:
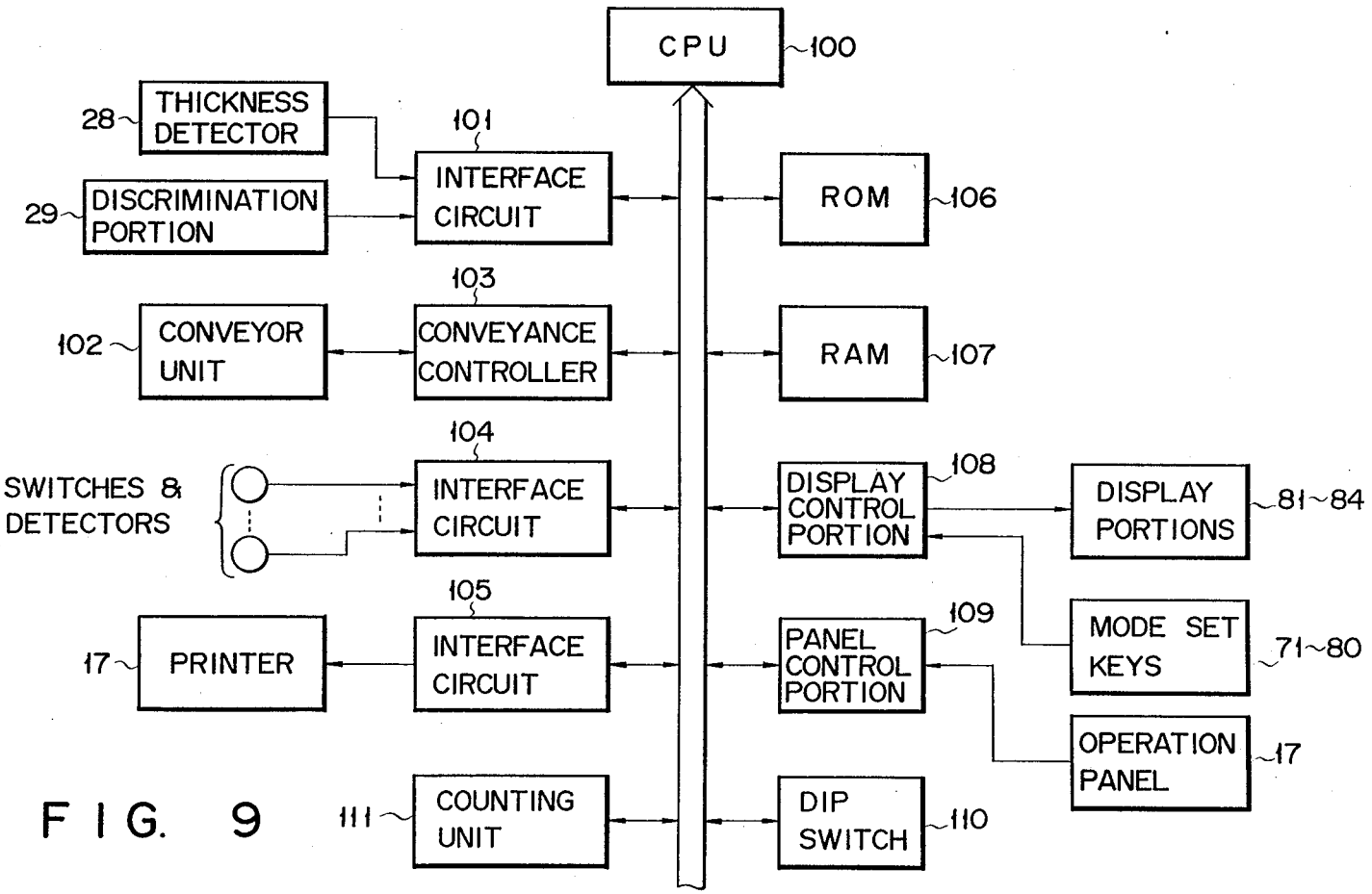
FIG. 9 is a block diagram of a controller of the embodiment.

A controller of the apparatus of the present invention is shown in FIG. 9. CPU 100 controls the entire apparatus, and thickness detector 28 and discrimination portion 29 are connected to CPU 100 through interface circuit 101. Conveyor unit 102, which forms conveyor path 27, is connected to CPU 100 through conveyance controller 103. The respective reed switches and detectors are connected to CPU 100 through interface circuit 104. CPU 100 checks conveyance control of banknotes and a state in the apparatus in accordance with information from the switches and detectors through interface circuit 104. Printer 19 is connected to CPU 100 through interface circuit 105 and prints out collection data in accordance with a command from CPU 100.

Read-only memory (ROM) 106 which stores control programs of the apparatus and random access memory (RAM) 107 for storing data collected in accordance with the denomination, face, and fitness of the banknotes are also connected to CPU 100. Display control portion 108 performs display control and is connected to CPU 100 and display portions 81 to 84 in display unit 20. Mode set keys 71 to 80 are connected to display control portion 108 and sends a command to CPU 100 to set a mode in accordance with inputs from the respective keys. Operation panel 17 is connected to panel control portion 109, which is connected to CPU 100. CPU 100 controls start, stop, and like operations for processing of banknotes in accordance with a command from operation panel 17. Note that DIP switch 110 is connected to CPU 100 so that a specific function of banknote processing apparatus 10 can be stopped in accordance with a command from switch 110. Counting unit 111 is connected to CPU 100 and counts banknotes stacked in temporary stackers 32, 33, and 34 and banknotes stacked in cassettes 37, 38, and 39.

An operation of the above embodiment will be described below. An operator sets cassettes 37, 38, and 39 in cassette portion 51. That is, he or she pulls out cassette portion 51 as shown in FIG. 5 and mounts cassettes 37, 38, and 39 therein. If all the cassettes are correctly set, reed switches 57*a*, 57*b*, and 57*c* are turned on. Therefore, CPU 100 determines that the cassettes are correctly set and then turns off LEDs 60*a*, 60*b*, and 60*c*.

When cassette portion 51 is pulled in the apparatus and cassettes 37, 38, and 39 are empty, these empty states are detected by detectors 44*a*, 44*b*, and 44*c*, respectively. If any of the cassettes are not empty, a corresponding one of LEDs 83*a*, 83*b*, and 83*c* is turned on. Therefore, since set and content states of the cassettes are displayed, the operator can immediately check whether the cassettes must be reset or another cassette must be set.

Then, the operator sets the mode. However, CPU 100 controls such that the designated account job is cancelled if the cassettes are not correctly set. That is, only when the cassettes are correctly set can the account job can be designated. Note that the count, face, fitness, and face & fitness modes can be designated regardless of the full or empty states of the cassettes. Furthermore, the stacking mode can be designated only when cassettes are correctly set and empty. Therefore, if banknotes remain in the cassettes, these remaining banknotes will not be mixed with those to be processed. As a result, noncoincidence does not occur between a count of the banknotes stored in the cassettes and that of the processed banknotes, and a mixed denomination state does not occur when banknotes of one denomination are to be stacked.

When stack key 78 is depressed in mode selection, the stacking mode is designated. If the stacking mode is not designated or clear key 79*d* is depressed, the "mode 0" is set.

An operation performed when the "mode 1" is designated will be described. In the "mode 1", cassettes 37, 38, and 39 are set to stack 10,000-yen banknotes, 1,000-yen banknotes, and banknotes of other denominations, i.e., 5,000-yen and 500-yen banknotes, respectively, and the set mode data is stored in RAM 107.

The operator sets all the banknotes in supply portion 11 and then depresses start key 94. The banknotes are picked up and fed into the apparatus by pickup roller 26, discriminated by discrimination portion 29, conveyed on conveyor path 27*b* through gate 31, and temporarily stacked in temporary stackers 32, 33, and 34. At the same time, display portions 81*a* to 81*d* of display unit 20 display count data, i.e., amounts of banknotes in units of denominations and display portion 81*e* displays a total amount. At this time, since the "mode 1" is set, 10,000-yen banknotes, 1,000-yen banknotes, and banknotes of other denominations, i.e., 5,000-yen and 500-yen banknotes are stacked in stackers 32, 33, and 34, respectively.

Note that display portions 81*a* to 81*d* sequentially display count results, i.e., counts of the banknotes during discrimination and, counting, and when discrimination and counting of the fed banknotes are completed, display total amounts in units of denominations. As described above, display portions 81*a* to 81*d* of operation portion 17 display not only amounts but also the counts of the banknotes. Therefore, the operator can immediately check whether discrimination and counting operations are stopped.

Then, the operator verifies the count data and the total amounts of the banknotes displayed in units of denominations on display portion 20 with an account slip. If the data coincide with the data written on the account slip, he or she depresses end key 88 of operation portion 17. CPU 100 sends a stacking operation command to conveyance control unit 103. Control unit 103 drives motor 68 and a drive source (not shown) of pushers 36. Therefore, shutters 35 are opened and pushers 36 are moved downward to push (store) the banknotes stacked in stackers 32, 33, and 34 into cassettes 37, 38, and 39.

At this time, microswitches 42*a*, 42*b*, and 42*c* detect an operation of pushers 36, and sensors 41*a*, 41*b*, and 41*c* detect the presence/absence of banknotes in temporary stackers 32, 33, and 34, respectively. When any of sensors 41*a* to 41*c* does not supply a sensor output, i.e., banknotes remain in a corresponding one of stackers 32, 33, and 34, CPU 100 determines a stack error has occurred.

When microswitches 42*a*, 42*b*, and 42*c* do not detect the returning of pushers 36 in a predetermined time after pushers 36 are driven to return, i.e., a predetermined time set for pushers 36 has elapsed, CPU 100 determines a stack error has occurred. When reed switches 70*a* and 70*b* for detecting opening/closing of shutters 35 detect that shutters 35 are not closed in a predetermined time, i.e., the predetermined time set for shutters 35 has elapsed, CPU 100 determines a stack error has occurred.

When CPU 100 identifies a stack error, the LED of display portion 84*k* of display unit 20 is turned on to inform the operator.

Operations of pushers 36 and shutters 35 are detected during the operations other than the stacking operation. When shutters 35 are opened or pushers 36 are moved while the stacking operation command is not sent from CPU 100, CPU 100 determines the occurrence of a stacker error, and LED 84 of display portion 84 of display unit 20 is turned on to inform the operator.

Therefore, since the stack error and the stacker error are displayed when errors occur in the cassettes, the operator can check for malfunctions in the apparatus and cope with the malfunction.

When the displayed data does not coincide with the data written on the deposit slip, as a result of verification, return key 86 of operation panel 17 is depressed to unlock lock 24. Therefore, as shown in FIG. 3, temporary stacking portion 45 can be pulled out in the arrow direction, and the operator can pick up the banknotes stacked in stacking portion 45. At this time, data displayed on display unit 20 and data stored in RAM 107 are cleared by CPU 100.

Two hundreds and two thousands banknotes can be stacked in each of temporary stackers 32, 33, and 34 and closed cassettes 37, 38, and 39, respectively, and counting unit 111 counts currently stacked banknotes during processing. For example, when a count of banknotes in stacker 32 reaches 200, i.e., stacker 32 becomes full in the "mode 1", CPU 100 and conveyance controller 103 control such that data is continuously collected but banknotes are guided to and stacked in open pocket 14. This is the same with the other stackers. Therefore, if a temporary stacking portion becomes full during the account processing, the account processing can be continuously performed, thereby improving processing efficiency. In this case, the banknote re-stacking operation is performed after the temporary stacking portion is emptied so that banknotes stacked in the open pocket are stacked in the temporary stacking portion without collecting data.

After the account processing is completed, CPU 100 stores counts and total amounts in units of denominations of banknotes stacked in the temporary stacking portion in the account processing in a first accumulation memory in RAM 107. CPU 100 also stores counts and total amounts in units of denominations of the banknotes stacked in the open pockets in the account processing in a second accumulation memory for banknotes outside the cassettes in RAM 107.

When the "mode 1" is completed and arrangement is to be performed, mode setting is performed first. For example, when the count key is depressed and the count mode is set, the operator supplies all the banknotes to supply portion 11 and depresses start key 94. The banknotes are picked up by pickup roller 26 one after another and arranged/stacked in open pockets 14, 15, and 16 in units of denominations through thickness detector 28 and discrimination portion 29. When count key 89 of operation panel 17 is depressed to designate count/arrangement of one hundred banknotes, the supply of banknotes is stopped when one hundred 10,000-yen banknotes are stacked in the open pocket. After the stacked 10,000-yen banknotes are picked up and the open pocket is emptied, the feeding of banknotes is started again. Similarly, 5,000-yen and 1,000-yen banknotes are stacked in open pockets 15 and 16, respectively. These stacking data are displayed on display unit 20.

A banknote whose kind cannot be discriminated by discrimination portion 29 or two or more banknotes picked up at the same time are stacked in rejecting open pocket 13 as a rejected banknote.

When arrangement is completed and the processing is to be performed in the stacking mode again, stack key 78 is depressed. In this case, "mode 1", stored in RAM 108 at initialization, is automatically set. This mode is not changed until the cassette is replaced and "mode 1" is automatically set each time stack key 78 is depressed. Therefore, erroneous mode changes can be prevented and banknotes of other denominations are not mixed in the cassettes. In addition, if the "mode 1" mode is to be set, mode setting need not be performed again, thereby reducing the work load of the operator.

When interruption is to be performed during the account processing, i.e., a large number of banknotes are being processed and the next processing cannot wait for the completion of the current account processing interruption key 80 is depressed. In this case, another processing can be performed while data being accounted is stored in RAM 108. The operator sets a job mode. In this case, as shown in Table 1, the counting mode and face mode can be set. That is, since banknotes are stacked in the temporary stacking portion and the open pockets are not used in the account processing, an arrangement operation using the open pockets can be executed.

After the processing is completed, by depressing either interruption key 80 or stack key 78, "mode 1" is set again. Then, the remaining banknotes are processed in "mode 1", and a count value after interruption is added to that before interruption. In addition, if the set mode is not the stacking mode but the arrangement mode, such as the counting mode, arrangement can be performed by interruption. Also in this case, when interruption key 80 is depressed after the interruption processing is completed, the original mode is automatically set again. Therefore, since mode designation need not be performed, the work load of the operator can be reduced, and erroneous mode changes can be prevented.

When the "mode 0" mode is set upon stacking mode setting, banknotes are stacked in the cassettes in a mixed state. That is, the banknotes are first stacked in cassette 37, and when cassette 37 becomes full, they are stacked in cassette 38. Thereafter, when cassette 38 becomes full, the banknotes are stacked in cassette 39. Therefore, the cassettes can be effectively used to reduce the frequency of exchanging cassettes and can improve working efficiency.

When job selection key 72 is switched to set account job and count key 73 is depressed, the account/counting processing is performed using the open pockets. At this time, banknotes are stacked in open pockets 14, 15, 16, and count data and the like are processed as in the stacking mode. This operation is performed when, e.g., tellers directly perform account operations and banknotes need not be stacked in the cassettes.

The re-stacking operation will be described below. This operation is similar to account/stacking processing. In this operation, the banknotes set in supply portion 11 are those subjected to the account/stacking processing once but are not yet stacked in cassettes 37, 38, and 39. For example, this would include the banknotes which were temporarily stacked in open pockets 14, 15, and 16 due to temporary stackers 32, 33, and 34 being filled in the account/stacking processing described above. Before the re-stacking processing starts, the temporary stackers must be emptied.

When stackers 32, 33, and 34 become full in the re-stacking processing, counting is stopped, and the operator depresses continuation key 95 of operation panel 17. Therefore, the banknotes stacked in stackers 32, 33, and 34 are stored in cassettes 37, 38, and 39.

When all the banknotes picked up from open pockets 14, 15, and 16 are sorted and stacked in temporary stackers 32, 33, and 34, the count operation ends. If end key 88 is depressed, the banknotes stacked in temporary stackers 32, 33, and 34 are pushed into closed cassettes 37, 38, and 39.

When the re-stacking processing is completed, CPU 100 subtracts counts and total amounts in units of denominations of the banknotes processed in the restacking processing from the second accumulation memory for banknotes outside the cassettes in RAM 107. Note that the data as shown in table 3, the counts and total amounts of the banknotes in units of denominations stored in the first accumulation memory in RAM 107, do not change.

TABLE 3

| | |
|---|---|
| First accumulation memory for banknotes stacked in the temporary stackers | Count of banknotes of 10,000 yen<br>Count of banknotes of 5,000 yen<br>Count of banknotes of 1,000 yen<br>Total amount |
| Second accumulation memory for banknotes outside the cassettes | Count of banknotes of 10,000 yen<br>Count of banknotes of 5,000 yen<br>Count of banknotes of 1,000 yen<br>Total amount |

Inquiring processing of accounted banknotes stacked in the open pocket will be described below. When the operator depresses inquiry key 87 of operation panel 17, CPU 100 reads out the contents of the second accumulation memory for accounted banknotes outside the cassettes (stacked in the open pocket) in RAM 107 and causes display unit 20 to display the contents on display portions 81*a* to 81*e*. This operation can be arbitrarily executed any time other than in the account/stacking processing and the re-stacking processing. Therefore, the operator can recognize counts and total amounts in units of denominations of banknotes not yet stacked in the cassettes even after accounting is completed.

As described above, the re-stacking mode is provided in addition to the account/stacking mode. In this mode, banknotes stacked in the open pockets because the temporary stackers are full and already subjected to the account processing on the data are stacked in the cassettes, thereby improving working efficiency.

The flowchart describing the above operations is shown in FIGS. 10A to 10G.

Figure 10A:
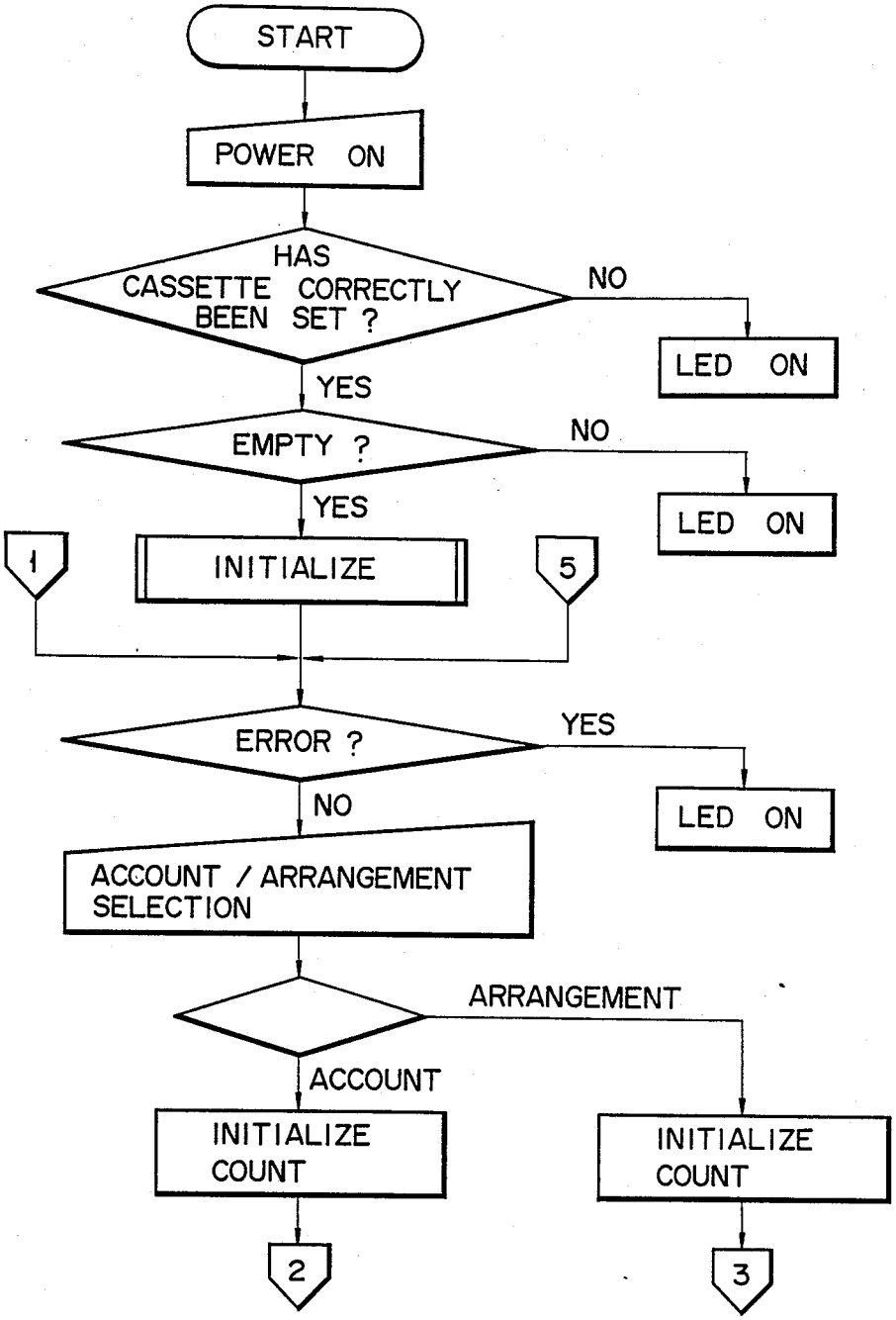
FIGS. 10A and 10G are a flowchart showing an operation of the embodiment of a banknote account and arrangement apparatus.

As shown in FIG. 10A, after the power is turned on, it is checked whether or not the cassettes have been correctly set and whether the cassettes are empty. When it is is determined that the cassettes have not been correctly set or the cassettes are not empty, the LEDs are turned on to inform the operator. When it is determined that the cassettes have been correctly set and the cassettes are empty, an "initialize" operation is done. Then, the "account/arrangement" mode is selected. Count data is initialized for each mode selected.

Figure 10B:
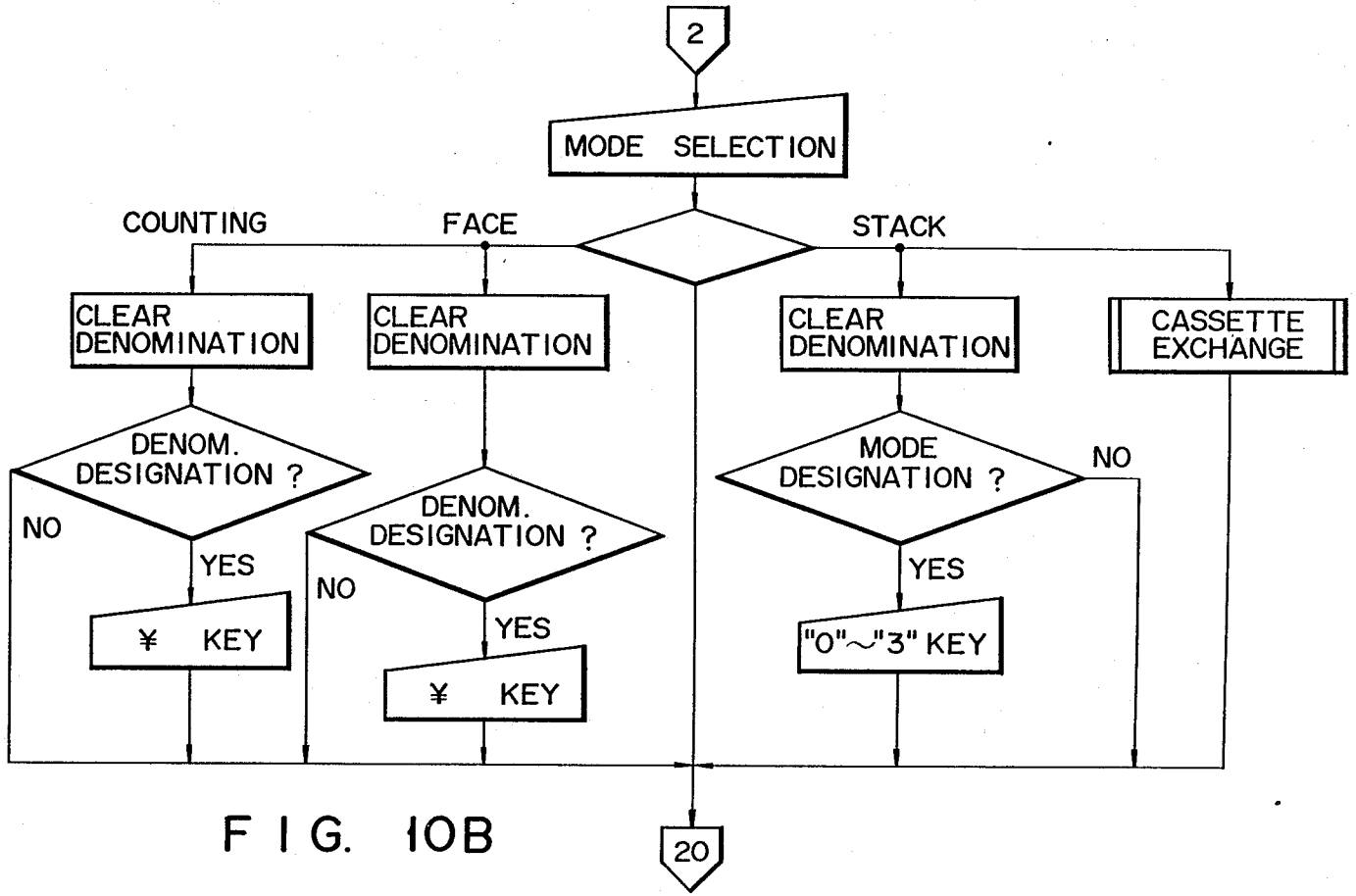

When the account mode is selected, a submode, such as counting, face, or stacking mode is selected as shown in FIG. 10B. In the counting and face modes, the denomination can be designated. In the stacking mode, one of "mode 0" to "mode 3" is selected.

Figure 10C:
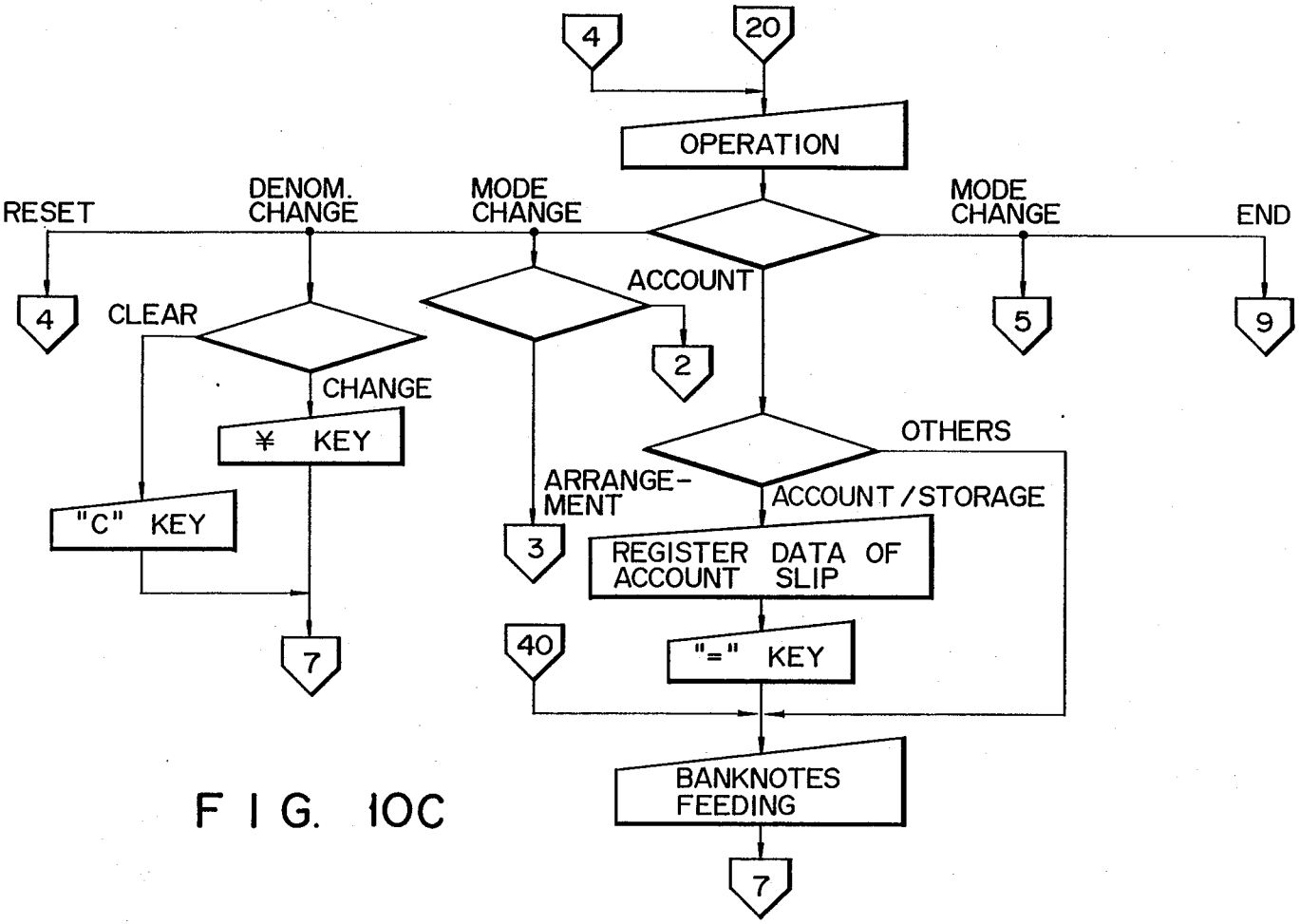

As shown in FIG. 10C, after the various settings are performed, the banknotes are fed into the apparatus.

Figure 10D:
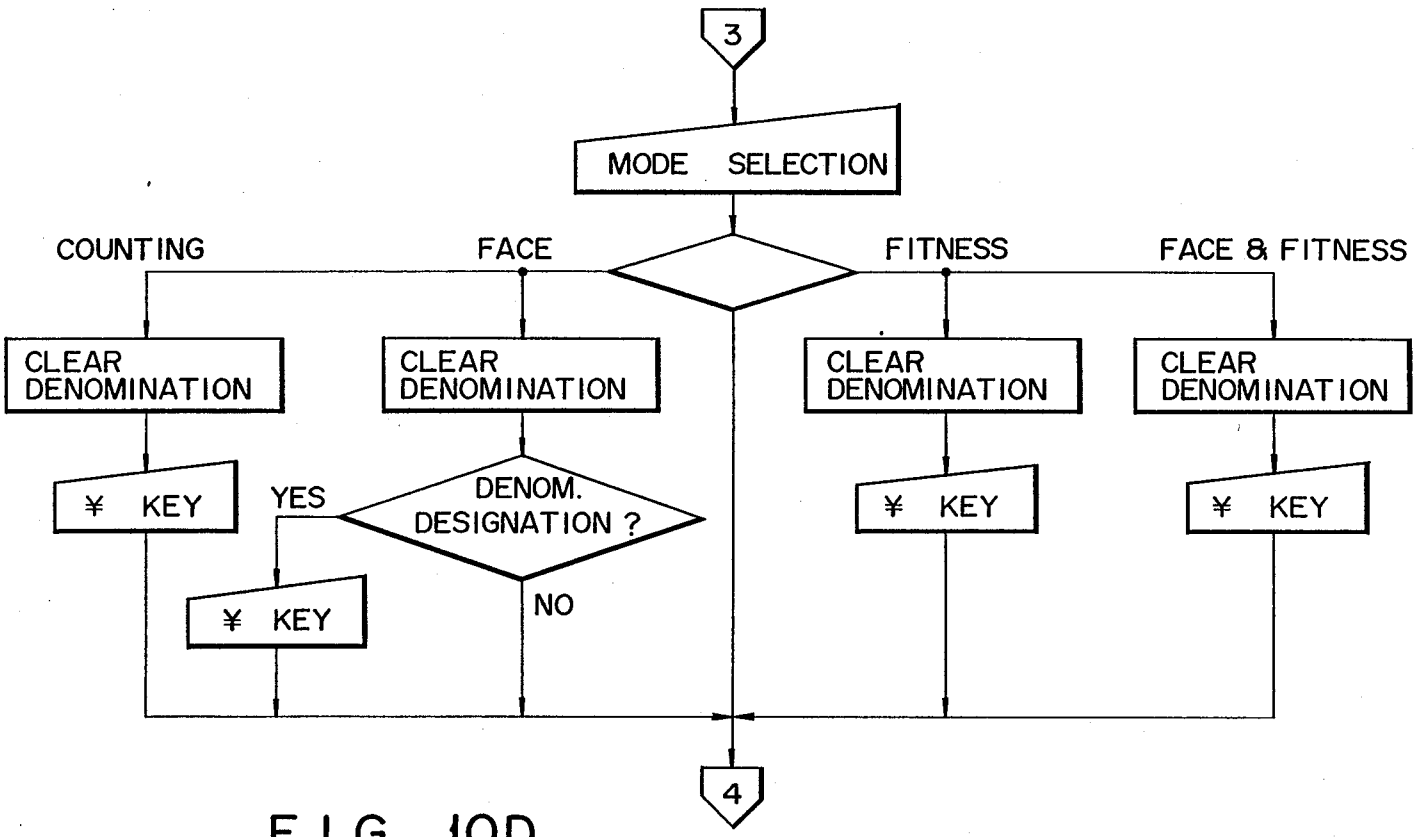

When the arrangement mode is selected, a submode, such as counting, face, fitness, or face & and fitness mode is selected as shown in FIG. 10D. In each mode, the denomination can be designated.

Figure 10E:
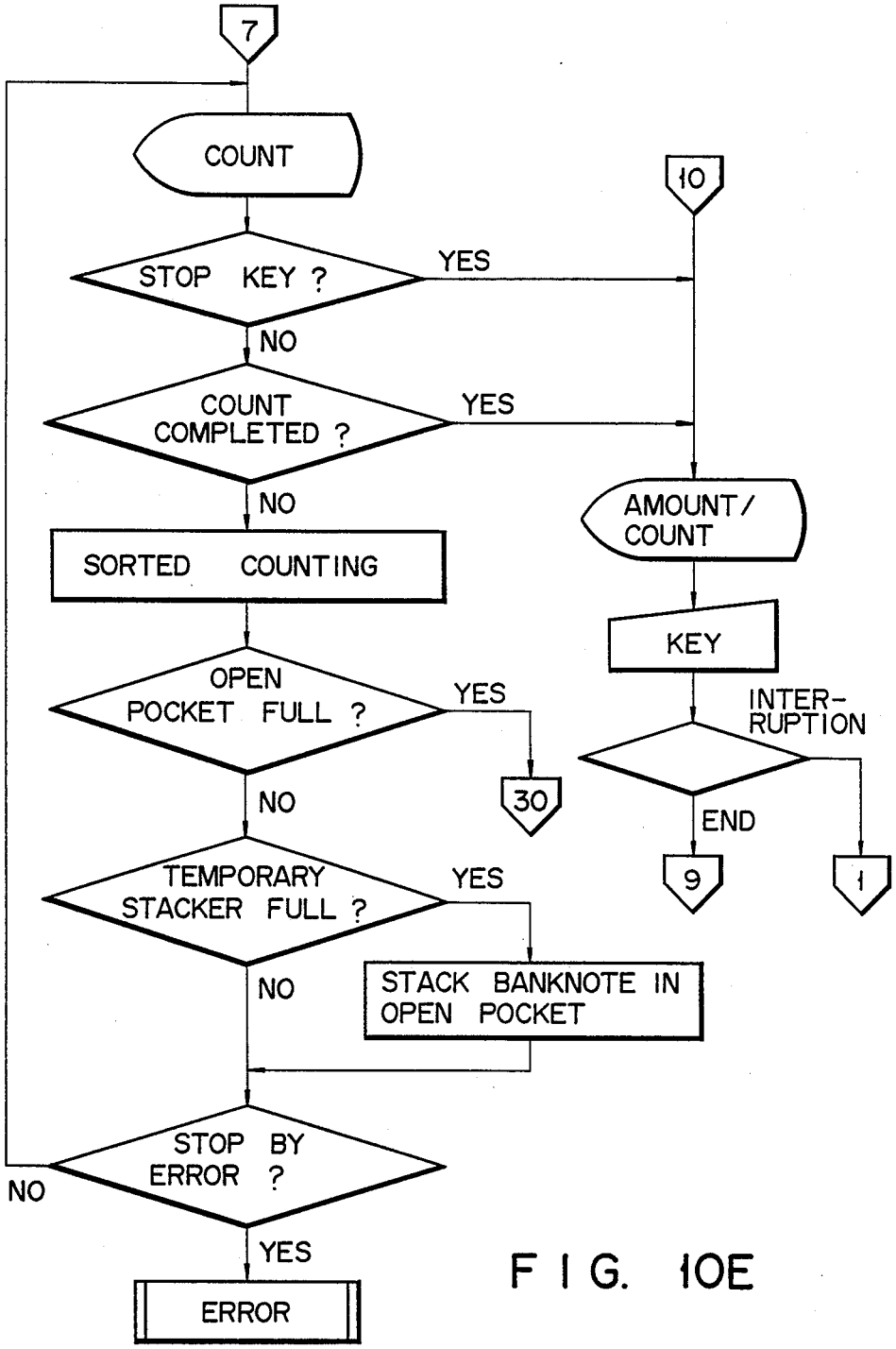

After the start of banknote feeding (FIG. 10C), the count of banknotes is displayed during processing and the count and amount of the banknotes upon the completion of the processing as shown in FIG. 10E. If the temporary stacker is full, the banknotes are stacked in the open pocket. If the processing is stopped by error, an "error" operation is done.

Figure 10F:
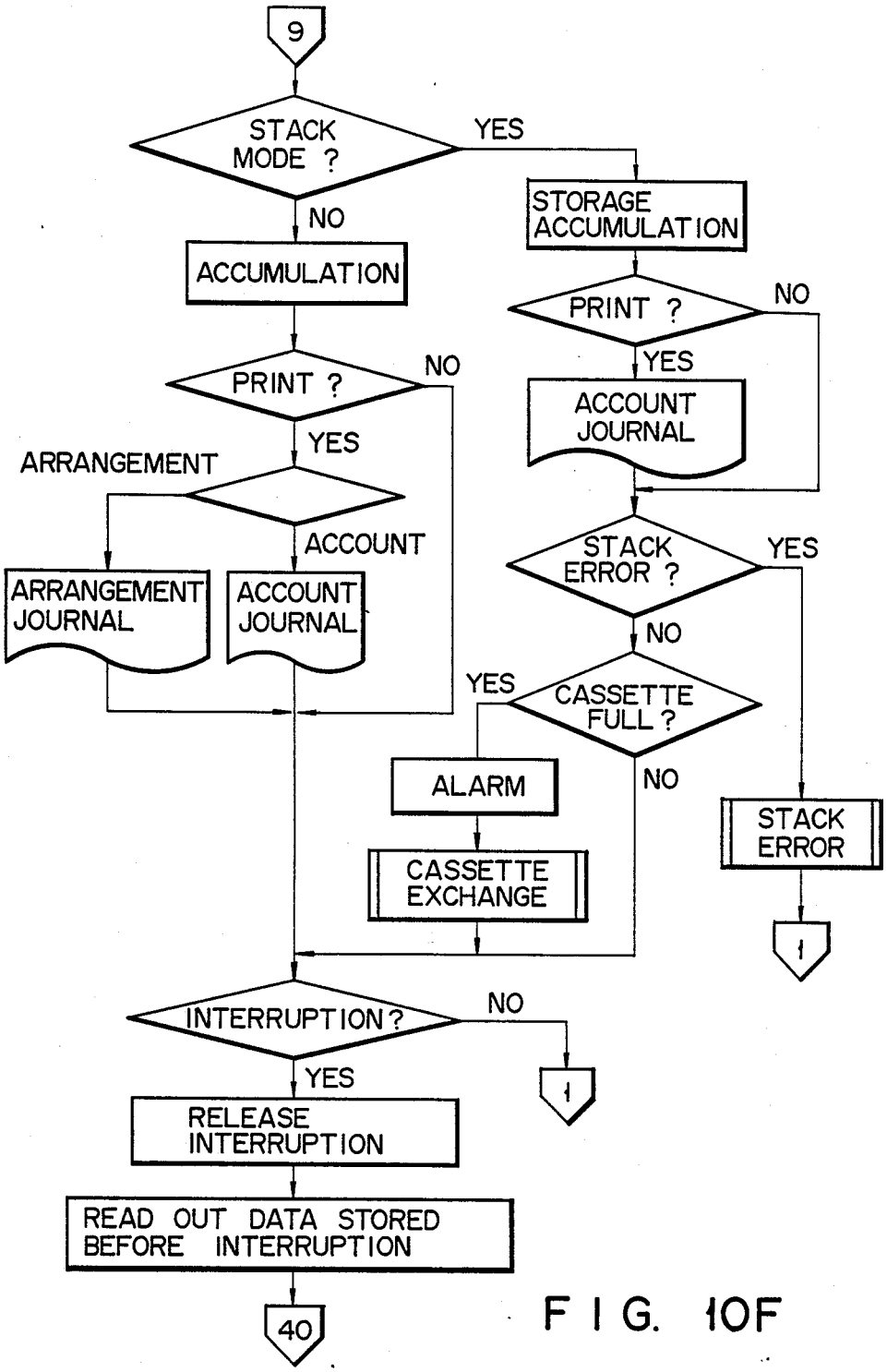
Figure 10G:
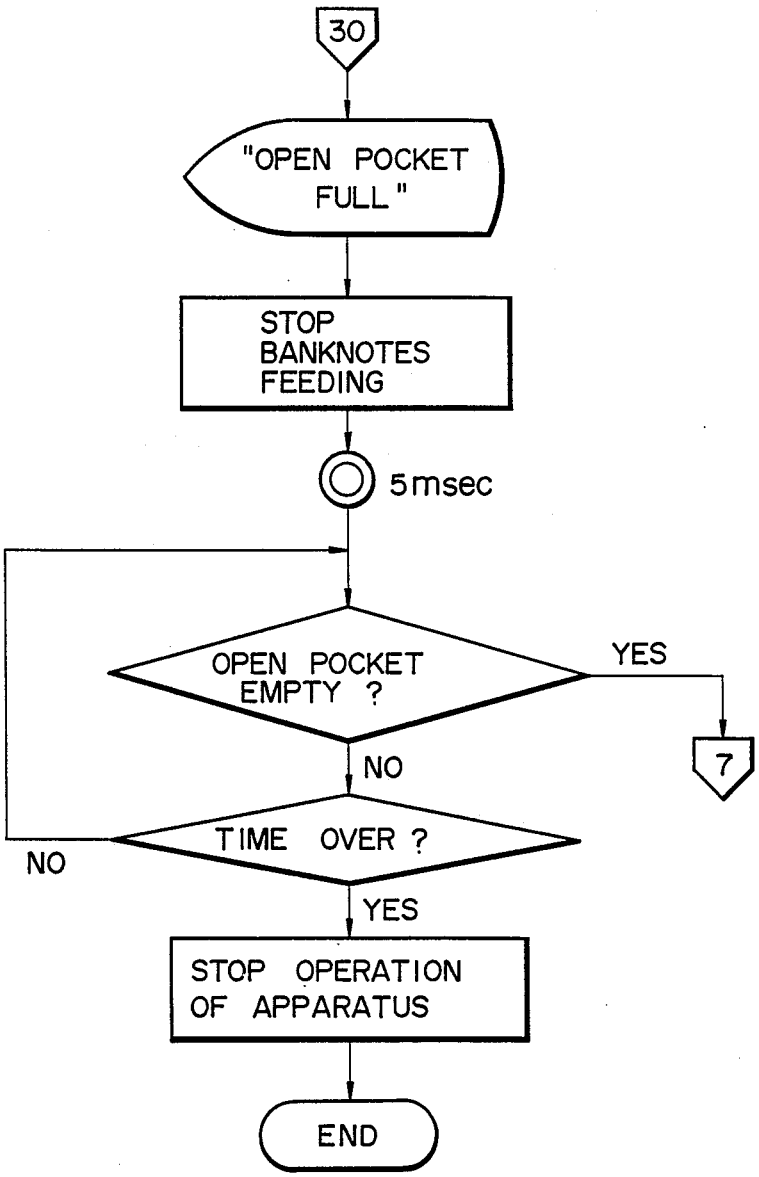

After the completion of the processing, the collected (accumulated) data is printed out as shown in FIG. 10F.

Note that the present invention can be applied not only to processing of banknotes, but also to processing of negotiable papers such as stocks, bonds, and checks. Stacking manners in the respective modes are merely examples for explanation, and the number of the closed cassettes and the like are not limited to those described above.

What is claimed is:

1. A banknote account and arrangement apparatus comprising:

feed means, into which a plurality of banknotes are set, for feeding the banknotes one by one;

mode designating means for designating one of an account mode and an arrangement mode;

first stacker means for stacking banknotes in the account mode, comprising a plurality of first stackers;

second stacker means for stacking banknotes in the arrangement mode, comprising a plurality of second stackers;

discriminating means for discriminating a kind of the banknote fed from the feed means;

means for (1) sorting the discriminated banknote into a respective one of the plurality of first stackers when the account mode is designated, and (2) sorting the discriminated banknote into a respective one of the plurality of second stackers when the arrangement mode is designated;

full-detecting means for counting the number of banknotes stacked in each of the first and second stackers and detecting whether one of the first and second stackers is full; and sorting-destination changing means for, when one of the first stackers is detected as being full in the account mode, sorting the banknotes, to be sorted into the full first stacker, into a corresponding one of the second stackers.

2. An apparatus according to claim 1, further comprising:

means for counting the numbers of banknotes stacked in each of the plurality of first stackers in the account mode and for generating count data corresponding to the numbers; and means for storing the count data for each of the plurality of first stackers.

3. An apparatus according to claim 2, wherein the counting means is also for counting the total number of discriminated banknotes for each kind of banknote, and the storing means is also for storing a predetermined total number for each kind of banknote set in the feed means.

4. An apparatus according to claim 1, wherein the first stacker means comprises:

temporary stacker means for stacking banknotes, comprising a plurality of temporary stackers;

cassette means for storing the banknotes stacked in the temporary stacker means, comprising a plurality of cassettes; and transfer means for transferring the banknotes stacked in corresponding ones of the plurality of temporary stackers to corresponding ones of the plurality of cassettes.

5. An apparatus according to claim 4, further comprising:

means for inputting predetermined count data for the banknotes set into the feed means;

means for counting the actual number of banknotes stacked in each of the plurality of temporary stackers in the account mode;

means for comparing the actual numbers with the predetermined count data;

means for driving the transfer means when the comparing means detects that the actual number coincide with the predetermined count data; and means for storing the actual numbers when the comparing means detects that the actual numbers coincide with the predetermined count data.

6. An apparatus according to claim 1, wherein banknotes sorted into corresponding ones of the plurality of second stackers in the account mode are replaced into said feed means, the apparatus further including a restacking mode wherein the banknotes sorted into corresponding ones of the plurality of second stackers and replaced into the feed means are stacked in corresponding ones of said first stackers.

7. An apparatus according to claim 1, further comprising:

first means for counting the number of banknotes stacked in each of the plurality of first stackers;

second means for counting the number of banknotes stacked in each of the plurality of second stackers; and data storing means for generating a total number of banknotes based on the number of banknotes counted by the first and second counting means and for storing the total number in the account mode.

8. An apparatus according to claim 1, in which the first stacker means comprises:

temporary stacker means for stacking banknotes, comprising a plurality of temporary stackers;

cassette means for keeping the banknotes stacked in the temporary stackers, comprising a plurality of cassettes; and transfer means for transferring the banknotes stacked into corresponding ones of the plurality of temporary stackers to corresponding ones of the plurality of cassettes.

9. An apparatus according to claim 8, further comprising:

means for inputting predetermined count data for the banknotes set into the feed means;

means for counting the actual number of banknotes stacked in each of the plurality of temporary stackers in the account mode;

means for comparing the actual numbers with the predetermined count data;

means for driving the transfer means when the comparing means detects that the actual numbers coincide with the predetermined count data; and means for storing the actual numbers when the comparing means detects that the actual numbers coincide with the predetermined count data.

10. An apparatus according to claim 1, in which the plurality of second stackers comprise open pockets provided on the apparatus, and the plurality of first stackers comprise closed cassettes provided inside the apparatus.

* * * * *